United States Patent [19]

Faccini

[11] 4,422,471

[45] Dec. 27, 1983

[54] FOUR BAR MANIFOLD

[75] Inventor: Ernest C. Faccini, Marbury, Md.

[73] Assignee: The United States of America as represented by the Secretary of the Navy, Washington, D.C.

[21] Appl. No.: 381,829

[22] Filed: May 24, 1982

[51] Int. Cl.[3] ..... B63K 7/00

[52] U.S. Cl. ..... 137/561 A; 266/48

[58] Field of Search ..... 266/51, 52, 48; 137/561 R, 561 A

[56] References Cited

U.S. PATENT DOCUMENTS

| | | | |
|---|---|---|---|
| 1,373,043 | 3/1921 | Amberg | 239/548 |
| 1,947,755 | 2/1934 | Bucknam et al. | 266/48 |
| 2,444,851 | 7/1948 | Rogers | 141/209 |
| 2,515,301 | 7/1950 | Hughey | 266/51 |
| 2,786,493 | 3/1957 | Bayer | 137/118 |
| 3,643,689 | 2/1972 | Isreeli et al. | 137/561 A |
| 3,848,633 | 11/1974 | Hurtig et al. | 137/561 A |

*Primary Examiner*—A. Michael Chambers

*Attorney, Agent, or Firm*—R. F. Beers; K. E. Walden; D. J. Breh

[57] ABSTRACT

A gas flow distribution manifold for distributing oxygen equally to a plurality of burn bar torches allowing large holes to be burned in steel objects is disclosed. The manifold includes a central plenum chamber connected to radial cross passages. Orifices connect the cross passages to outlet chambers wherein the burn bar torches are mounted. Sonic gas flow is maintained through the orifices providing equal flow to the torches.

2 Claims, 2 Drawing Figures

FOUR BAR MANIFOLD

BACKGROUND OF THE INVENTION

The invention relates to gas flow distribution manifolds. More particularly this invention relates to gas flow distribution manifolds having equal flow to each of a plurality of outlets. The manifold distributes oxygen gas equally to each of a plurality of cutting torches known as burn bars for thermochemically cutting holes in thick metal objects.

Heretofore, gaining access to the interior of closed containers having no available access thereto, and the cutting of relatively large holes in thick steel plates has been accomplished with oxyacetylene cutting system to heat and rapidly oxidize the metal by introducing oxygen into the flame. This method requires the use of a fuel such as acetylene and associated piping and undivided fuel and oxygen flow regulation and distribution means.

Another method of cutting holes in thick steel objects is by thermochemically eroding the metal by heating the metal and introducing oxygen gas to a torch known as a burn bar. A plurality of burn bars can be arranged so that the holes burned by adjacent torches overlap as the metal erodes, leaving a single hole of the desired size. So that a hole of maximum uniform size can be cut with the fewest number of burn bars, it is essential that each adjacent hole be as nearly equal in size as possible. If one or more of the torches burns a hole smaller than an adjacent torch, either the ultimate hole size desired will not be cut or additional torches must be added to assure that overlapping of the adjacent holes occurs. Equal cutting by each torch requires that the flow of oxygen to each torch be equal.

SUMMARY OF THE INVENTION

It is an object of the invention to provide for a distribution manifold that allows a given diameter hole to be thermochemically burned in a steel object using the fewest number of burn bar torches.

It is another object of the invention to provide for a gas distribution manifold that allows simultaneous and equal penetration of steel objects through thermochemical errosion of a plurality of adjacent holes.

Another object of the invention is to provide for a gas distribution manifold that supplies oxygen gas uniformly and equally to a plurality of burn bar torches.

The objects are achieved by providing for a manifold having a central plenum chamber for receiving oxygen gas and for distributing. The gas to each of a plurality of cross passages extending radially outward from the central plenum chamber to orifices sized to maintain sonic gas flow therethrough. The orifices discharge the oxygen to outlet chambers wherein the individual burn bar torches are mounted. The orifices assure that the gas flow will be maintained uniform and equal between all torches, thus resulting in simultaneity and equality of penetration.

DETAILED DESCRIPTION OF THE PREFERRED EMBODIMENT

Figure 1:
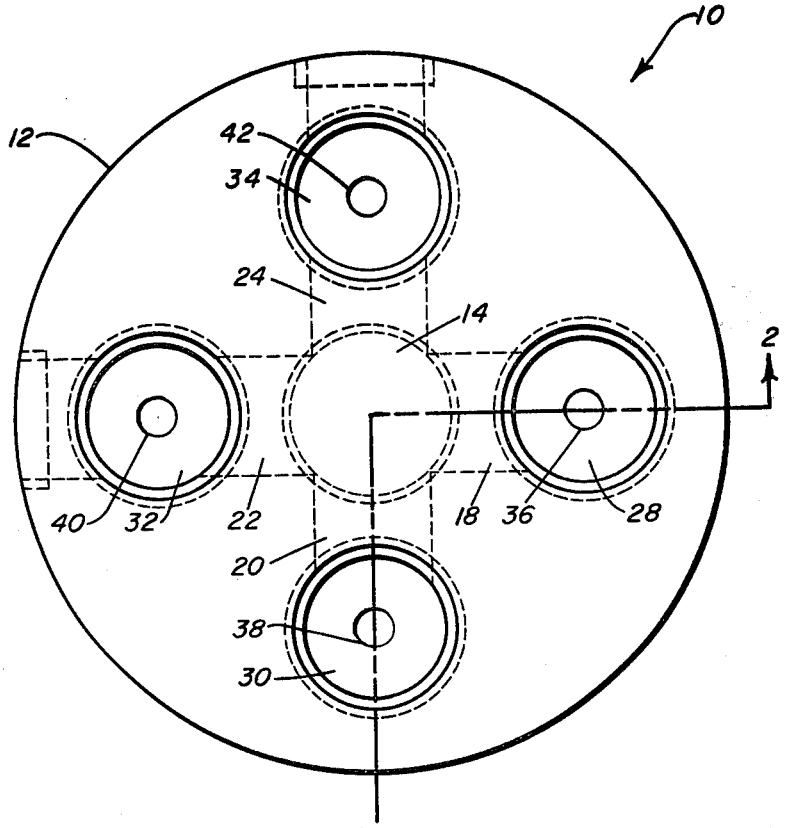
FIG. 1 is a plan view of the distribution manifold.
Figure 2:
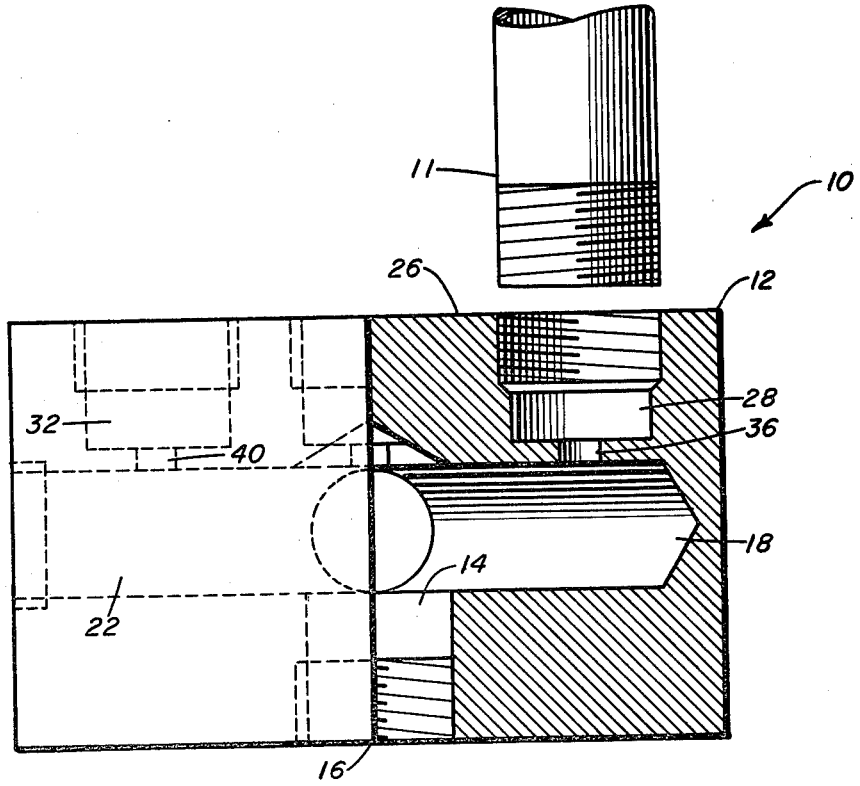
FIG. 2 is a partial cross-sectional view of the manifold showing details of construction.

Shown in FIGS. 1 and 2 is a manifold 10 for distributing oxygen gas equally to each of a plurality of torches 11, one of which is shown in FIG. 2, known as burn bars. Body 12 is preferably cylindrical in shape and has a central plenum chamber 14 for receiving oxygen gas from an external source, not shown. Inlet 16 is threaded for receiving an appropriate gas fitting, not shown. Body 12 has cross passages 18, 20, 22, 24, either drilled through body 12 or cast therein so that the inlet of each passage connects at right angles to central chamber 14. The cross passages are located radially and equally spaced around central plenum chamber 14.

Drilled or cast into body 12 perpendicularly from forward face 26 are outlet chambers, 28, 30, 32, 34. The outlet chambers are adapted to receive the burn bar torches and have inlets connected to orifices 36, 38, 40, 42. The orifices each have their inlets connected to one of the respective cross passages. The orifices are co-axially aligned with the outlet chambers and extend perpendicularly toward face 26. The orifices are sized so that the velocity of flow of the gas therethrough will be sonic and therefore, the flow to and between each burn bar will be uniform and equal. Orifice diameters on the order of 0.110″ to 0.116″ for a gas inlet pressure on the order of 200 psig has been found to yield the desired uniform and equal gas flow between all outlets.

The number of outlet chambers, and therefore the number of orifices and cross passages, depends on the diameter of the hole to be burned. Likewise the location of the center of each outlet chamber as measured radially from the center of plenum chamber 14 is dependent on the diameter of the hole to be burned. Large diameter holes will require a greater number of torches than will small holes. The embodiment shown has four outlet chambers, orifices and cross passages but is not to be considered limited thereto. The advantageous qualities of the manifold disclosed herein lies in the fact that a hole of a given diameter can be burned in the fewer burn bars than heretofore possible, due to the increased uniformity and simultaneity of penetration achieved.

PREFERRED MODE OF OPERATION

In operation, inlet 16 is connected to an external supply of oxygen capable of maintaining a minimum pressure of 200 psig at the inlet. Burn bar torches are mounted into each outlet chamber and a source of heat for initiating the oxidation of the metal when the oxygen is introduced is provided between the burn bars and the workpiece. The introduction of a heat source and initiation of the burning process are well known in the field. The oxygen supply is initiated and oxygen flows into chamber 14 through the radial cross passages and is maintained at sonic velocity through the orifices. A uniform and equal flow of oxygen passes through the outlet chambers to each torch.

Having described the preferred embodiment and operation, other embodiments and modifications will come to the mind of one skilled in the art of gas flow manifolds. It is to be understood that this invention is not limited thereto and that said embodiments and modifications are to be included in this the scope of the appended claims.

What is claimed is:

1. A manifold for uniformly and equally distributing gas to each of a plurality of burn bar torches for burning holes in objects comprising:

a body member having at least one face, said body member further including;

a central plenum chamber having an inlet for receiving the gas, a plurality of equally spaced radially extending cross passages, each of said passages having one end connected to said plenum chamber for carrying the gas out of said plenum chamber, a plurality of orifices, each of said orifices having an inlet end connected to one of said respective cross passages and extending from said cross passage in perpendicular relation to said body face for receiving the flow of gas from said cross passage, said orifices adapted to maintain sonic gas flow therethrough, a plurality of outlet chambers, each of said outlet chambers having an inlet end connected in coaxial relationship to one of said respective orifices and extending perpendicularly to said face for receiving the flow of gas from said orifices and for distributing the gas to the burn bar torches, said outlet chambers adapted to receive the burn bar torches whereby, the flow of gas is distributed uniformly and equally to each of the burn bar torches and the burn bar torches burn holes of equal size in the object.

2. The manifold as defined in claim 1 wherein the orifices have diameters in the range of 0.110" to 0.116".

* * * * *